US008657134B2

(12) United States Patent
Morath

(10) Patent No.: US 8,657,134 B2
(45) Date of Patent: Feb. 25, 2014

(54) HOISTING LIMIT SWITCH AND LIFTING DEVICE

(75) Inventor: Erwin Morath, Lauterach (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 576 days.

(21) Appl. No.: 12/903,582

(22) Filed: Oct. 13, 2010

(65) Prior Publication Data

US 2011/0089131 A1 Apr. 21, 2011

(30) Foreign Application Priority Data

Oct. 16, 2009 (DE) ..... 20 2009 014 066 U

(51) Int. Cl.
*B66C 13/18* (2006.01)
*B66D 1/48* (2006.01)

(52) U.S. Cl.
USPC ..... 212/281; 254/269

(58) Field of Classification Search
USPC ..... 254/266, 267, 268, 269, 270, 271, 272, 254/273; 212/281; 200/47
See application file for complete search history.

(56) References Cited

U.S. PATENT DOCUMENTS

| | | | | | |
|---|---|---|---|---|---|
| 876,503 | A * | 1/1908 | Suliot | 254/269 |
| 1,558,635 | A * | 10/1925 | Rutan | 212/281 |
| 3,922,789 | A * | 12/1975 | Sarrell | 33/702 |
| 3,969,714 | A * | 7/1976 | Greer | 340/679 |
| 4,170,308 | A * | 10/1979 | Rogers | 212/281 |
| 4,219,121 | A * | 8/1980 | McPeak | 212/281 |
| 4,300,134 | A * | 11/1981 | Paciorek | 340/685 |
| 4,471,877 | A * | 9/1984 | Whitly | 212/273 |
| 4,897,754 | A * | 1/1990 | Konishi et al. | 361/1 |
| 4,943,715 | A * | 7/1990 | Konishi | 250/229 |
| 5,263,660 | A * | 11/1993 | Brozik | 254/269 |
| 5,405,027 | A * | 4/1995 | Plass | 212/281 |
| 5,420,571 | A * | 5/1995 | Coleman et al. | 340/644 |
| 5,645,181 | A * | 7/1997 | Ichiba et al. | 212/281 |
| 6,068,145 | A * | 5/2000 | Luke | 212/281 |
| 8,181,798 | B2 * | 5/2012 | Moller | 212/276 |
| 2003/0127408 | A1 * | 7/2003 | Schneider | 212/281 |
| 2008/0302750 | A1 * | 12/2008 | Worboys | 212/281 |

FOREIGN PATENT DOCUMENTS

| | | | | |
|---|---|---|---|---|
| DE | 19856264 | A1 | 7/1999 | |
| DE | 20208474 | U1 | 10/2002 | |
| DE | 202004008083 | U1 | 11/2005 | |
| DE | 102006025002 | A1 | 12/2007 | |
| DE | 202008008174 | U1 | 12/2009 | |
| JP | 09048590 | * | 2/1997 | B66C 23/88 |

(Continued)

OTHER PUBLICATIONS

Machine Translation of JP 10 007379 A, http://www4.ipdl.inpit.go.jp, Feb. 6, 2013.*

(Continued)

*Primary Examiner* — Emmanuel M Marcelo
*Assistant Examiner* — Justin Stefanon
(74) *Attorney, Agent, or Firm* — Alleman Hall McCoy Russell & Tuttle LLP

(57) ABSTRACT

The present disclosure relates to a hoisting limit switch for limiting the maximum allowed hoisting height of a hoisting cable, wherein the hoisting limit switch includes a read-write device for reading and writing data, and a means from which the operating condition of the hoisting limit switch can be read out by the read-write device.

24 Claims, 5 Drawing Sheets

(56) References Cited

FOREIGN PATENT DOCUMENTS

| | | | | | |
|---|---|---|---|---|---|
| JP | 10007379 | A | | 1/1998 | |
| JP | 2002137893 | A | * | 5/2002 | ..... B66C 23/88 |
| RU | 2401793 | C1 | * | 10/2010 | ..... B66C 15/00 |
| WO | WO 2007137634 | A1 | * | 12/2006 | ..... B66C 13/16 |
| WO | 2009/089628 | A1 | | 7/2009 | |

OTHER PUBLICATIONS

ISA German Patent and Trademark Office, Search Report of 20 2009 014 066.0, Feb. 19, 2010, Germany, 4 pages.
European Patent Office, Search Report of EP 10 00 8963, Apr. 27, 2011, Netherlands, 6 pages.

* cited by examiner

HOISTING LIMIT SWITCH AND LIFTING DEVICE

CROSS REFERENCE TO RELATED APPLICATIONS

This application claims priority to German Utility Model Application No. 20 2009 014 066.0, entitled "Hoisting Limit Switch and Lifting Device", filed Oct. 16, 2009, which is hereby incorporated by reference in its entirety for all purposes.

TECHNICAL FIELD

The present disclosure relates to a hoisting limit switch for limiting the maximum allowed hoisting height of a hoisting cable, and to a lifting device, in particular a crane or cable excavator, comprising at least two different guiding means for guiding at least one hoisting cable, wherein at least one winch is provided for driving the at least one hoisting cable.

BACKGROUND & SUMMARY

Lifting devices, in particular cranes, mobile or crawler cranes as well as tower cranes or cable excavators, can be configured in various set-up variants. A load to be lifted is attached to the hoisting cable of a crane or excavator, with the hoisting cable being guided by a guiding means over the boom head up to the drive of the hoisting cable in the form of a cable winch. At this point, numerous variation possibilities are available for guiding the hoisting cable via the boom. For example, the hoisting cable can be guided at the pulley head itself over the boom or over a mast nose attached to the boom end or at various further points of a boom extension, such as, e.g., a folding tip, a luffing tip or a fixed tip. At each of these points, a load including stop means and hook block thus can be lifted.

During retraction of the hoisting cable by the respective cable winch it must be ensured that the hoisting height of the cable is limited such that a crane hook arranged at the hoisting cable or a hook block arranged at the same is not drawn into the cable guide rollers of the guiding means. Retracting the hoisting cable beyond the maximum allowed hoisting height may lead to a damage of the cable guide rollers or even to a rupture of the hoisting cable or the hook block and hence to the load falling down.

To prevent the above-mentioned problems, the actual hoisting height of the hoisting cable or the load must be controlled continuously at the respective guiding means and be communicated to a control unit provided for controlling the crane or excavator operation. A further difficulty consists in that the various guiding means arranged at the crane or excavator may be designed to be usable for simultaneously lifting more than one load. Consequently, the safe operation must be monitored by more than one cable winch.

One method for monitoring the hoisting height of the hoisting cable provides for mounting a so-called hoisting limit switch to each individual guiding means. The function of a hoisting limit switch known from the prior art provides that a weight is longitudinally movably guided on a hoisting cable and attached to the hoisting limit switch via a connecting means. When the stop means of the hoisting cable disallowedly approaches the boom or boom head, the weight is lifted by the stop means on the hoisting cable and the connecting element of the hoisting limit switch is relieved, whereby the hoisting limit switch is actuated and for example interrupts the drive of the hoisting cable. In general, the hoisting limit switches known from the prior art are configured as reed limit switch, Hall switch, inductive switch or as mechanically contacted limit switch. Said switches are largely based on magnetic action principles and are sensitive to strong interfering fields as may occur, e.g., in electroplating plants.

A disadvantage of the above-mentioned monitoring systems for lifting devices consists in that on each guiding means a monitoring element in the form of a hoisting limit switch must always firmly be mounted. However, in such lifting devices only so many guiding means actually can be utilized as drives are present in the form of winches. Thus, in a lifting device with two winches and five guiding means three monitoring elements always remain unused.

Upon actuation of a monitoring element in the form of a hoisting limit switch, the function of the controller of the lifting device is to regulate the drives of the associated hoisting cable (winch). Although the controller clearly knows the position of the respective hoisting limit switch, the controller has no information as to which hoisting cable is actually guided by which winch at the respective hoisting limit switch. This input must be made by the crane operator before operating the crane and thus is susceptible to errors. Only when the crane operator deliberately actuates one winch only and moves the same into the hoisting limit switch, can the controller safely know about the allocation between winch, hoisting cable and hoisting limit switch. Current solutions known from the prior art provide that all winches must be stopped at the same time upon actuation of a hoisting limit switch, independent of which of these actually have exceeded the maximum allowed hoisting height of their driven hoisting cable.

Therefore, it is the object of the present disclosure to provide a lifting device which provides an improved monitoring system of the hoisting cable. Furthermore, it is the object of the present disclosure to disclose a hoisting limit switch which provides an improved possibility for monitoring the hoisting cable and can be used in such lifting device.

This object is solved by a hoisting limit switch for limiting the maximum allowed hoisting height of a hoisting cable. The limit switch includes a read-write device for reading and writing data, and a means from which the operating condition of the hoisting limit switch can be read out by the read-write device. Said means includes information characterizing the operating condition of the hoisting limit switch. For example, the means can include information which describes an allowed operating condition of the hoisting limit switch, which requires that a load attached to the hoisting cable does not exceed a maximum allowed hoisting height. When the maximum allowed hoisting height is reached or exceeded, which involves a risk of destruction of the guiding means, said means indicates a forbidden operating condition. Upon occurrence of a forbidden operating condition certain protective measures can be taken by the hoisting limit switch.

In addition, the read-write device also offers the possibility of reading out data which go beyond the above-mentioned content or to write any desired data onto the means or further receiving elements. Further data to be read out via the read-write device can include, e.g., information on the place of use of the hoisting limit switch. It is also conceivable that during assembly of the hoisting limit switch of the present disclosure the read-write device can write data into a receiving means present at the place of use, which data are a fundamental prerequisite for a reliable functionality of the hoisting limit switch.

Advantageously, the means comprises two transponders which communicate the respective operating condition of the hoisting limit switch to the read-write device. When the first transponder is positioned in the reading area of the read-write device, information is provided which characterizes the allowed operating condition of the hoisting limit switch. By contrast, a second transponder positioned in the reading area of the read-write device leads to the fact that a forbidden operating condition is read out and predefined measures can be taken by the hoisting limit switch of the present disclosure. Particularly preferably, either the first or the second transponder or both transponders are located in the reading area of the read-write device, so that a malfunction of the hoisting limit switch can be recognized as soon as no transponder is detected in the reading area of the read-write device. This is the case for example with a defective read-write device. Thus, a failure of the read-write device also is detectable. When both transponders are located in the reading and writing area of the read-write device, this exactly symbolizes the condition of the transition between allowed and forbidden operating condition. Thus, state transitions can be detected particularly early and measures can be taken. Only a solution with transponders, in particular two transponders, can ensure the high degree of safety of the hoisting limit switch.

Advantageously, the two transponders are mounted one beside the other on a movably guided carrier. The carrier is connected with the hoisting cable at the place of use by suitable means, so that a mechanical action can be transmitted to the movably guided carrier via the hoisting cable, which leads to a displacement of the transponders. In the allowed operating condition, the movably guided carrier preferably is positioned such that the first transponder is located in the reading area of the read-write device. When the hoisting cable reaches a forbidden maximum hoisting height, the hoisting cable acts on the movably guided carrier such that the carrier is displaced and the second transponder enters into the reading area of the read-write device.

It can be provided that the read-write device is configured such that various transponders, which are distributed in several directions, are detectable and readable and/or writable. Consequently, the read-write device has at least two different reading and writing areas, in which suitable means, in particular transponders, are readable and writable.

It is particularly expedient that the hoisting limit switch includes a transponder which is arranged externally in direct vicinity of the hoisting limit switch and is readable and/or writable by means of the read-write device. It is conceivable that such external transponder is already preassigned with data, which upon incorporating the external transponder into the reading and writing area of the read-write device are readable or writable from or into the same. For example, the external transponder is firmly fixed at a possible position of use of the hoisting limit switch. During assembly of the hoisting limit switch, the externally arranged transponder is moved into the reading and writing area of the read-write device, whereby important data for operation of the hoisting limit switch can be read out from the externally arranged transponder.

Advantageously, a means for connection to a bus system for transmitting data is provided on the hoisting limit switch. Consequently, the hoisting limit switch can be used in a system comprising a plurality of individual hoisting limit switches of the present disclosure, and the respective operating conditions of the individual hoisting limit switches of the present disclosure can be transmitted to a central control unit via the bus system. It is also conceivable that via the bus system information on the operation is supplied to the individual hoisting limit switches.

It is also possible that information on the precise mounting position of the hoisting limit switch of a lifting device can be transmitted.

To measure the allowed maximum hoisting height of a hoisting cable, it is provided that the hoisting limit switch includes a weight which can longitudinally movably be mounted on a hoisting cable of a lifting device and is attachable or attached to the hoisting limit switch by means of a connecting element. The use of a longitudinally guided weight on the hoisting cable is known from the hoisting limit switches known from the prior art. In the hoisting limit switch of the present disclosure, the weight longitudinally movably guided on the hoisting cable acts on the means, in particular the two transponders, via the connecting means such that upon relieving the weight a forbidden operating condition can be read out by the read-write device.

In a preferred embodiment of the hoisting limit switch of the present disclosure, the same includes a quick-assembly device. The same provides for releasably and particularly flexibly mounting the hoisting limit switch to the desired place of use.

It is conceivable that the quick-assembly device is firmly fixed at the place of use or already integrated in the component at the place of use of a lifting device and the externally arranged transponder is integrated in the same. It is imaginable that inside the externally arranged transponder data are stored which contain information on the precise place of use. In particular, the externally arranged transponder is located inside the quick-assembly device during assembly of the hoisting limit switch in the reading and writing area of the read-write device. Fixing the quick-assembly device at the place of use offers a constructive possibility for converting existing cranes to the solution in accordance with the present disclosure. Preferably, the quick-assembly device is already integrated in the component of a corresponding crane.

The present disclosure furthermore relates to a lifting device, in particular a crane or cable excavator, comprising at least two different guiding means for at least one hoisting cable for lifting a load, wherein at least one winch is provided for driving the at least one hoisting cable. In accordance with the present disclosure, the lifting device includes at least one sensor device in direct vicinity of each of the at least two guiding means, wherein each sensor independently detects its mounting position. During the crane operations, a load preferably is unilaterally attached to the end of the hoisting cable or preferably the hoisting cable is directed about a deflection pulley at a hook block and at its end attached to the boom by means of a lock or the like. Driving the hoisting cable is effected via a cable winch, wherein the hoisting cable is selectively guided over the boom by one of the guiding means. Crane configurations with a plurality of cable winches are conceivable, which drive various hoisting cables each guided by different guiding means.

The sensors used monitor the operating condition of the lifting device at the respective guiding means. By a sensor automatically detecting its mounting position it is ensured that a reliable and automatic allocation of the sensor to the respective guiding means is effected. By contrast, lifting devices known from the prior art require that an allocation of sensor and guiding means is effected manually by the operator of the lifting device. However, this involves a risk potential hard to assess, which is solved efficiently by the present disclosure.

Particularly preferably, the sensors are releasably mountable or mounted at the respective mounting position. This offers the advantage that sensors need only be mounted at those guiding means which are actually required during operation of the crane. By automatically detecting its own position, the sensor can selectively be positioned at one of the existing guiding means of the lifting device, with the allocation to the guiding means being effected independently due to the position detection of the sensor. By means of this variant of the lifting device in accordance with the present disclosure, the correct allocation of winch, hoisting cable and sensor is simplified considerably. Appreciable risks which can result from a faulty configuration of the sensors can be limited to a minimum.

Expediently, the sensors are designed such that they metrologically detect the position of the hoisting cable, in particular the exceedance of the maximum allowed hoisting height of the hoisting cable, at the guiding means. Hence, the maximum allowed hoisting height of a hoisting cable of the lifting device in accordance with the present disclosure can be monitored and definable measures possibly can be taken when this height is exceeded. Furthermore, it can separately be detected for each individual guiding means whether the correspondingly guided hoisting cable of the individual guiding means has reached a critical maximum hoisting height.

In a particularly advantageous aspect of the present disclosure a control unit is provided in the lifting device, which is connectable or connected with at least one or all sensors. In this way, all or part of the metrologically detected sensor data can be transmitted to the central control unit and be evaluated by the same. In accordance with the present disclosure, it is known to the control unit which sensors are positioned on which guiding means and are responsible for monitoring the same.

It is conceivable that the control unit receives data from at least one sensor, such as the serial number of the lifting device component on which the sensor is arranged and/or the current hoisting cable position and/or an address assigned to the mounting position and/or geometrical data of the lifting device component, such as mass and geometrical data of the component or also the coordinates of the center of gravity.

It is also possible that the control unit transmits data to the sensors. These data can relate, e.g., to the load spectrum.

Expediently, at least one of the sensors comprises a hoisting limit switch according to any of embodiments I to XXII (vide infra). The read-write device of the hoisting limit switch according to any of embodiments I to XXII hence is in constant communication with said control unit of the lifting device. The read-write device on the one hand pursues the object to read out the current operating condition of the hoisting limit switch and transmit the same to the control unit. On the other hand, it is one of the objects of the hoisting limit switch to determine the current mounting position of the hoisting limit switch and to transmit data, such as the serial number of the steel component to which the hoisting limit switch is attached, the coordinates of the center of gravity, mass and geometrical data of the component and an unambiguous address assigned to the hoisting limit switch, to the control unit, whereby an exact allocation of the hoisting limit switch to the guiding means, the hoisting cable guided over the same and the winch driving the hoisting cable is possible. Furthermore, it is possible that during use of the crane data can be written into the externally arranged transponder by means of the read-write device.

The central control unit of the lifting device of the present disclosure, which receives the data of the sensors connected with the same, is configured such that the at least one winch can be actuated in dependence on the data transmitted to the control unit. For example, the operation of the winch can be deactivated if the sensors detect an exceedance of the maximum allowed hoisting height of a hoisting cable.

It is particularly expedient that the control unit is configured such that several winches can be actuated separately in case of need. Due to the inventive allocation of the sensors to the respective guiding means exactly one winch responsible for the operation of the hoisting cable can be switched off in case of need, i.e. when the maximum allowed height of the hoisting cable of a guiding means is exceeded. In contrast to the variants of a lifting device known from the prior art, it is not necessary here to switch off all winches in case of need, but exactly one winch can specifically be switched off.

To achieve even greater safety, it is expedient that the control unit is configured such that before commencement of the crane operation the individual actuation of each assigned sensor ready for use can be controlled by the controller. Thus, it is ensured that it is clearly known to the control unit which winch performs a hoisting task at which point. This simplifies in particular the separate actuation of the winches by the control unit in case of need.

Since the individual sensors are connected with the control unit in a bilateral exchange of data, it is conceivable that a possible defect of a sensor can be detected by the control unit. For example, when a sensor transmits faulty data or none at all with respect to its mounting position, the control unit will infer a defect of the sensor.

It is also possible that the lifting device of the present disclosure, in particular the sensors for monitoring the guiding means, likewise can be used during the hoisting operations performed for assembly purposes of the lifting device of the present disclosure. As an example, reference is made to the assembly of a lattice boom with the SA trestle or the derrick boom.

DETAILED DESCRIPTION

Figure 1:
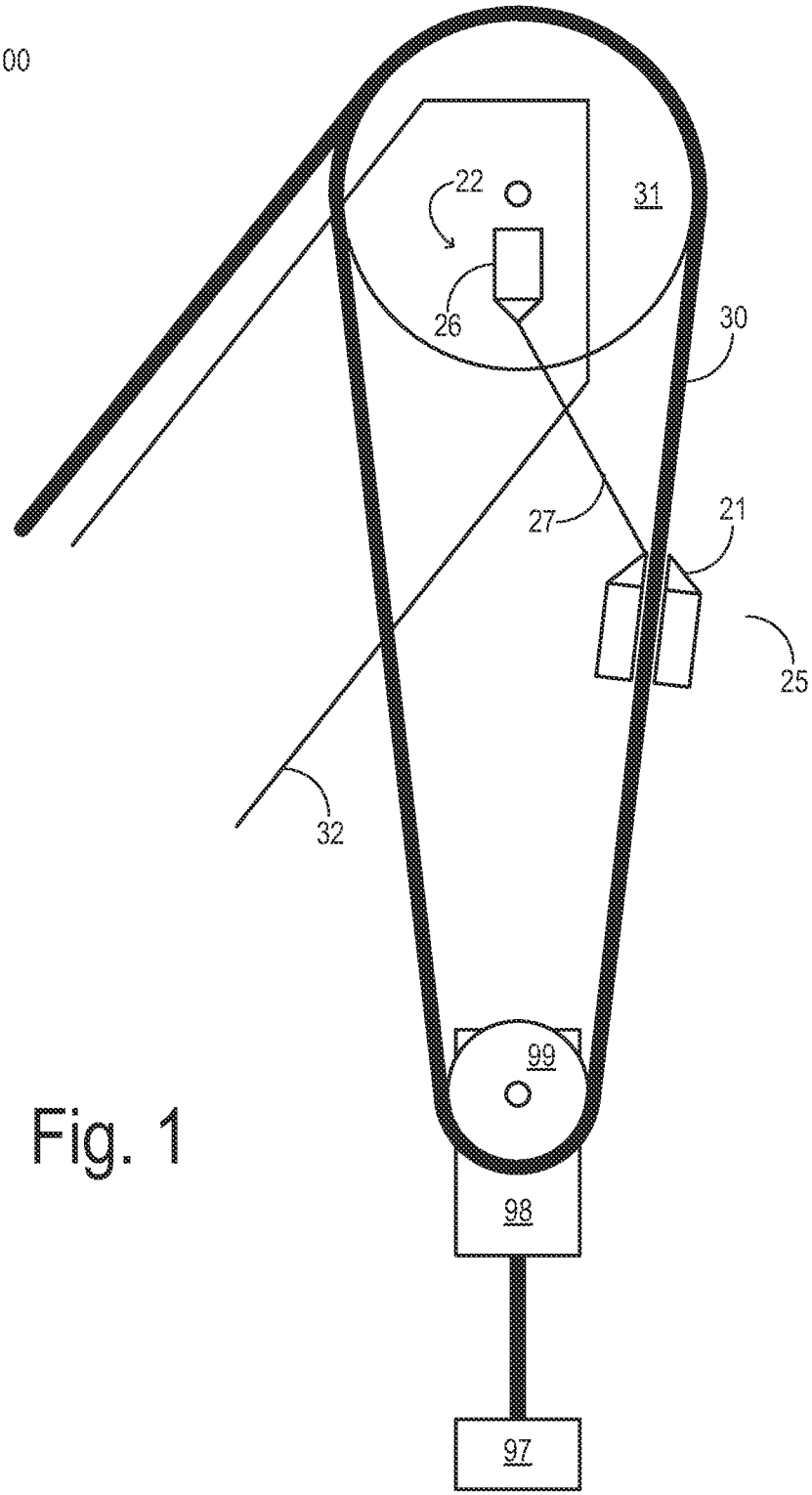
FIG. 1 shows a detailed view of a lifting device with a hoisting limit switch of the present disclosure arranged thereon.

The subject matter of the present disclosure is now described by example and with reference to the illustrated embodiments listed above.

The present disclosure includes the following non-limiting embodiments, which are now described in greater detail and with reference to the attached drawing figures:

I. A hoisting limit switch (22) for limiting the maximum allowed hoisting height of a hoisting cable (30), characterized in that the hoisting limit switch (22) includes a read-write device (20) for reading and writing data, and a means from which the operating condition of the hoisting limit switch (22) can be read out by the read-write device (20).

II. The hoisting limit switch (22) according to aspect I, characterized in that the means comprises two transponders (T1, T2) which communicate the respective operating condition of the hoisting limit switch (22) to the read-write device (20).

III. The hoisting limit switch (22) according to aspects I or II, characterized in that the transponders (T1, T2) are mounted one beside the other on a movably guided carrier (23).

IV. The hoisting limit switch (22) according to any of the preceding aspects, characterized in that the transponders (T1, T2) are arranged inside the hoisting limit switch (22) such that either the first (T1) or the second transponder (T2) is located in the reading area of the read-write device (20) depending on the operating condition.

V. The hoisting limit switch (22) according to any one of (including each of) the preceding aspects, characterized in that the read-write device (20) includes a plurality of reading and writing areas, so that various transponders (T1, T2, T3), which are distributed in several directions, are detectable and readable and/or writable.

VI. The hoisting limit switch (22) according to any one of (including each of) the preceding aspects, characterized in that the hoisting limit switch (22) includes an externally arranged transponder (T3) which is readable and/or writable by means of the read-write device (20), wherein the external transponder (T3) is assigned or assignable with data.

VII. The hoisting limit switch (22) according to any one of (including each of) the preceding embodiments, characterized in that the hoisting limit switch (22) includes a means (24) for connection to a bus system for transmitting data.

VIII. The hoisting limit switch (22) according to embodiment VII, characterized in that the hoisting limit switch (22) is configured such that data on the operating condition and/or the mounting position of the hoisting limit switch (22) can be transmitted.

IX. The hoisting limit switch (22) according to any one of (including each of) the preceding embodiments, characterized in that a weight (25) is provided on the hoisting limit switch (22), which can be mounted on a hoisting cable (30) of a lifting device and is attached or attachable to the hoisting limit switch (22) by means of a connecting element (21).

X. The hoisting limit switch (22) according to embodiment IX, characterized in that with a relieved weight (25) the read-write device (20) detects a forbidden condition.

XI. The hoisting limit switch (22) according to any one of (including each of) the preceding embodiments, characterized in that the hoisting limit switch (22) can releasably and flexibly be mounted at the place of use via a quick-assembly device (50).

XII. The hoisting limit switch (22) according to embodiment XI, characterized in that the externally arranged transponder (T3) is integrated in the quick-assembly device (50) and firmly attaches the same to the position of use or is already integrated in the component of a lifting device.

XIII. A lifting device, in particular a crane or cable excavator, comprising at least two different guiding means (1, 2, 3) for at least one hoisting cable (30) for lifting a load, wherein at least one winch (8) is provided for driving the at least one hoisting cable (30), characterized in that at least one sensor device is arranged in direct vicinity of each of the at least two guiding means (1, 2, 3) on the lifting device, wherein each sensor independently detects its mounting position.

XIV. The lifting device according to embodiment XIII, characterized in that the sensors are releasably mountable or mounted at the mounting position.

XV. The lifting device according to any one of (including each of) embodiments XIII to XIV, characterized in that the sensors are designed such that they metrologically detect the hoisting cable position at the guiding means (1, 2, 3).

XVI. The lifting device according to any one of (including each of) embodiments XIII to XV, characterized in that the lifting device provides a control unit (4) which is connectable or connected with at least one or all sensors.

XVII. The lifting device according to embodiment XVI, characterized in that the control unit (4) receives data from at least one sensor, in particular the serial number of the lifting device component (40) on which the sensor is arranged and/or the hoisting cable position and/or address assigned to the sensor by the mounting position and/or geometrical data of the lifting device component (40).

XVIII. The lifting device according to any one of (including each of) embodiments XIII to XVII, characterized in that at least one of the sensors comprises a hoisting limit switch (22) according to any one of (including each of) embodiments Ito XXII.

XIX. The lifting device according to any one of (including each of) embodiments XVI to XVIII, characterized in that the control unit (4) actuates the at least one winch (8) in dependence on the transmitted data of the sensors.

XX. The lifting device according to embodiment XIX, characterized in that the control unit (4) is configured such that several winches (8) can be actuated separately in case of need.

XXI. The lifting device according to any one of (including each of) embodiments XVI to XX, characterized in that the control unit (4) is designed such that before commencement of the crane operation all attached sensors are actuated.

XXII. The lifting device according to any one of (including each of) embodiments XVI to XXI, characterized in that a defective sensor can be detected by the control unit (4).

FIG. 1 schematically shows aspects of a lifting device 100 in one embodiment. The lifting device includes cable guide 31—an example guiding means for one or more hoisting cables. The cable guide is rotatably arranged on boom 32 of the lifting device. In one embodiment, the cable guide may include a pulley. FIG. 1 also shows hoisting cable 30, which is guided over cable guide 31 and over deflection pulley 99 of hook block 98. From there, the hoisting cable returns to the boom and is attached to the boom via a lock or the like.

When hoisting cable 30 is retracted, cable guide 31 rotates in a counterclockwise direction, so hook block 98 and load 97, suspended thereon, is lifted. Care must be taken so that the load and the hook block are not drawn into the cable guide, which may lead to damage of the cable guide or rupture of the hoisting cable or the hook block. To reduce these risks, limit switch 22 is arranged in direct vicinity of (e.g., adjacent) cable guide 31. The limit switch may be configured to interrupt a retractive drive of the hoisting cable when a maximum allowed hoisting position of the load or the hook block is reached or exceeded.

In one embodiment, limit switch 22 comprises a data-storage system configured to store data reflecting an operating condition of the limit switch. The limit switch further comprises a read-write device having a read-write area. The read-write device is configured to read data from the data-storage system through the read-write area.

Operation of limit switch 22 is now described in one embodiment, with reference to FIG. 1. In lifting device 100, limit switch 22 is arranged inside a housing 26. One end of connecting cable 27 is linked to the limit switch. The opposite end of the connecting cable is linked to connecting element 21. In the illustrated embodiment, weight 25 is suspended from the connecting element. Completely surrounding hoisting cable 30, the weight is longitudinally movably guided on the hoisting cable. Thus, the connecting cable and connecting element link the weight to the limit switch.

During normal operating conditions, the downward force of weight 25, via connecting cable 27 and connecting element 21, exerts a first force on the limit switch. These conditions correspond to an allowed condition of limit switch 22. However, when a load or hook block approaches weight 25, which is guided on the hoisting cable, and lifts the same upwards against its weight force, the force acting on the limit switch is relieved or reduced. Under these conditions, the connecting cable and connecting element exert a second force, different than the first, on the limit switch. These conditions correspond to a forbidden condition of the limit switch. The changed condition is detected by the limit switch and may be forwarded to a control unit of the lifting device via a bus system.

Figure 2:
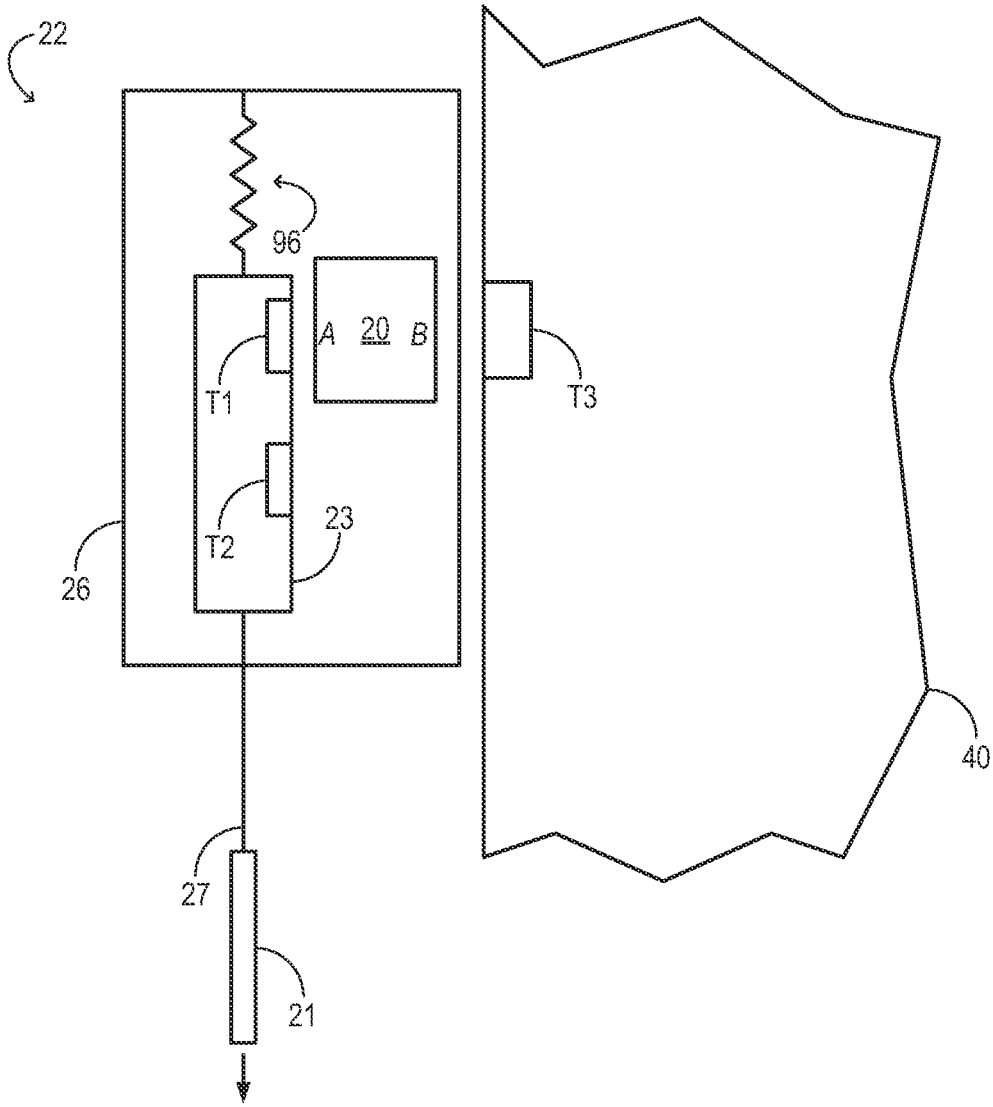
FIG. 2 shows a schematic representation of the hoisting limit switch of the present disclosure in the allowed operating condition.

The schematic design of limit switch 22 is now described with reference to FIG. 2. Inside housing 26 of limit switch 22, read-write device 20 is provided. The read-write device includes a plurality of read-write areas, which are oriented in (e.g., point) in different directions. A first read-write area A of the read-write device 20 points in direction of the movable carrier 23 located laterally on the left beside the read-write device 20.

In one embodiment, the data-storage system comprises first and second transponders addressable by read-write device 20. The transponders may be inductively operating transponders, for example. In FIG. 2, therefore, on the movably guided carrier 23 first transponder T1 and second transponder T2 are arranged and mounted in vertical direction one below the other, with first transponder T1 being located above second transponder T2. By moving the movable carrier 23 along a vertically arranged axis, either the first transponder T1 or the second transponder T2 is moved into read-write area A of read-write device 20. In this manner, the movably guided carrier moves with respect to the read-write area in response to an operating condition of the limit switch, such that either the first or the second transponder moves into the data reading area, depending on the operating condition. At the lower end of movable carrier 23, connecting cable 27 is arranged, at whose free end the connecting element 21 is suspended to accommodate weight 25. When the weight force of the weight 25 acts on limit switch 22 via the connecting cable and connecting element 21, movable carrier 22 is moved downwards along a vertical axis, so that the first transponder T1 is located in read-write area A of read-write device 20. In this position, the data stored on first transponder T1 is read out by read-write device 20. The data stored on first transponder T1 characterizes the allowed operating condition of limit switch 22, in which the load attached to the hoisting cable 30 has not yet reached the maximum allowed hoisting height. When weight 25 is relieved by the load or hook block of the hoisting cable 30 (corresponding to the functional principle explained in FIG. 1) movable carrier 23, preferably mounted in a spring-loaded manner, is shifted upward in vertical direction due to the spring restoring force of spring 96.

Figure 3:
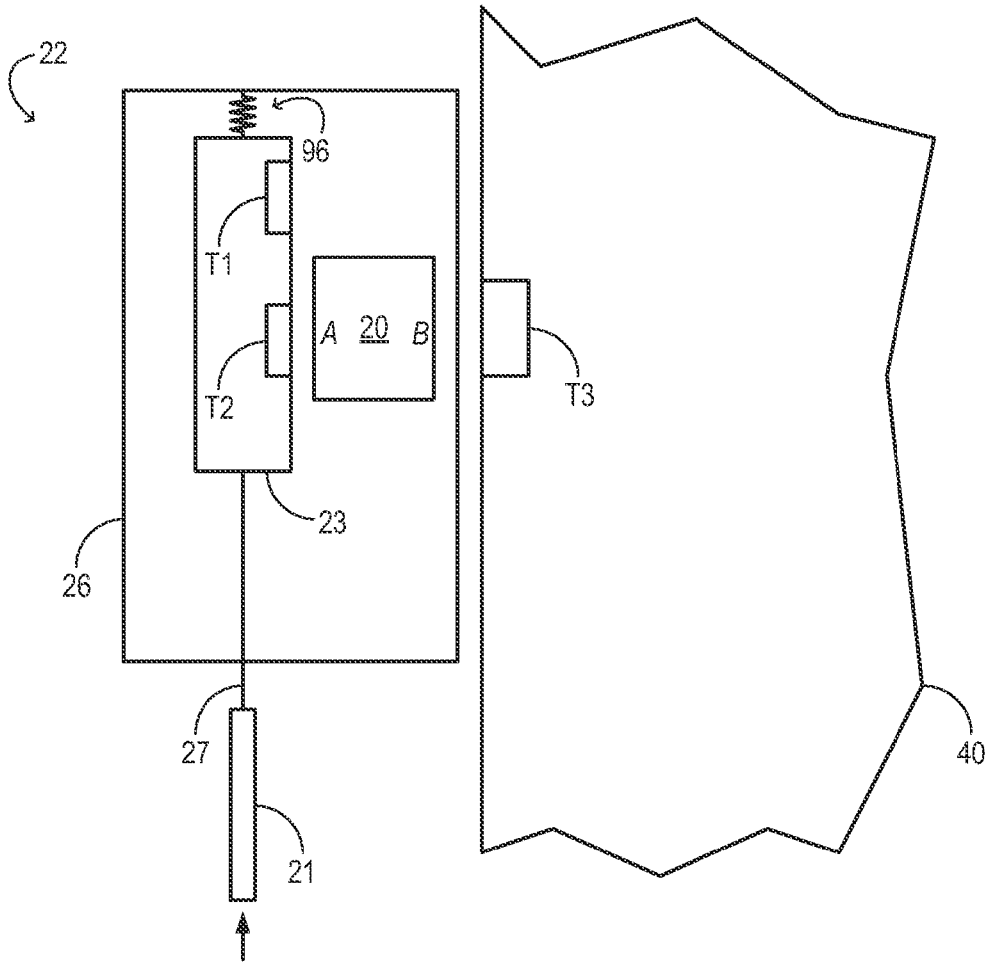
FIG. 3 shows a schematic representation of the hoisting limit switch of the present disclosure in the forbidden operating condition.

FIG. 3 shows the condition of the hoisting limit switch 22 with the weight 25 lifted up via the load or hook block. Here, the second transponder T2 is located in read-write area A of the read-write device 20. Consequently, the data are read out from the transponder T2 by the read-write device 20 and interpreted as a forbidden operating condition of the limit switch.

In sum, the first transponder moves into the read-write area when the operating condition is an allowed condition; the second transponder moves into the read-write area when the operating condition is a forbidden condition. In other embodiments, the read-write device may be configured to read data from and write data to the data-storage system through a plurality of data-reading and data-writing areas. The first and second transponders may be among a plurality of transponders of the data-storage system addressable by the read-write device. Further, the plurality of transponders may be distributed in two or more directions.

In the illustrated embodiment, the data-storage system further comprises a third, externally arranged transponder addressable by read-write device 20. The third transponder, as described hereinafter, may be assigned data reflecting a mounting position of the limit switch, while other forms of data are contemplated as well. Accordingly, in FIGS. 2 and 3, reference numeral 40 designates the particular component of the lifting device at which the limit switch 22 is mounted. Such particular components may include parts of a boom system, as further described below with reference to FIG. 6. At these points, external transponders T3 may be mounted. These transponders T3 are assigned with data which clearly define the component 40. Such data may include, for example, information on the serial number of the steel component 40, coordinates of the center of gravity or mass and geometrical data of the component, etc. Likewise, a unique address may be stored on transponder T3, making the transponder T3 unambiguously identifiable by the lifting-device controller.

In the illustrated embodiment, read-write device 20 has the further task of reading out transponder T3. Accordingly, the read-write device includes a plurality of reading and writing areas oriented in different directions. Limit switch 22 may be mounted on component 40 in direct vicinity of transponder T3. Transponder T3 is located in a second read-write area B, preferably laterally on the right beside the hoisting limit switch of the read-write device. In this configuration, the transponder T3 will be recognized and read out. Reading out the transponder T3 at the place of attachment of the hoisting limit switch 22 provides for an automatic position detection of the hoisting limit switch 22. The self-detected position represents the basis for clearly allocating a guiding means to be checked, a hoisting cable or a drive winch of the lifting device to each hoisting limit switch 22.

In contrast to the hoisting limit switches known from the prior art, hoisting limit switch 22 need not be correlated manually to a winch or load by the operator. Rather, its role and position is detected automatically and free from human error by the hoisting limit switch itself.

Figure 4:
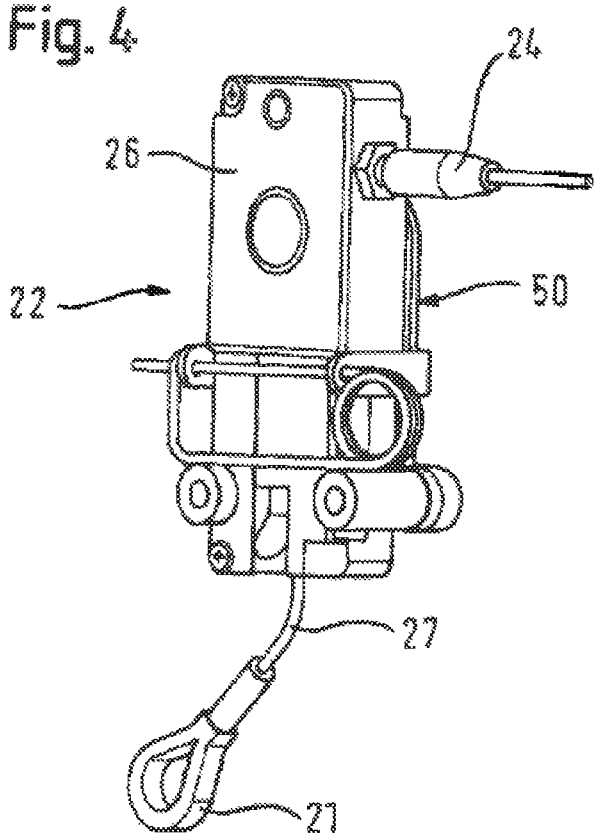
FIG. 4 shows a side view of the hoisting limit switch of the present disclosure.

FIG. 4 shows a further detailed view of the hoisting limit switch 22 of the present disclosure. At the lower end of the hoisting limit switch 22, a loop-shaped connecting element 21 arranged at the free end of the cable 27 is provided for attachment of a weight 25. The limit switch may further comprise a connection to a bus system for transmitting data from the data-storage system to a controller. To be able to transmit the collected data of the read-write device 20 to a central control unit, the hoisting limit switch 22 includes a bus connection 24. The hoisting limit switch 22 hence can be connected to a central bus system, which accomplishes the communication between the individual hoisting limit switches 22 inside a system and with a control unit.

To provide for a quick and safe assembly of the hoisting limit switch 22, a quick-assembly embodiment is provided. Accordingly, the limit switch may comprise a demountable portion where the data-storage system and the read-write device are coupled, and a mounting portion from which the demountable portion is releasable via a quick release. The mounting portion may be firmly fixed at the lifting device in direct vicinity of the cable guide.

Figure 5:
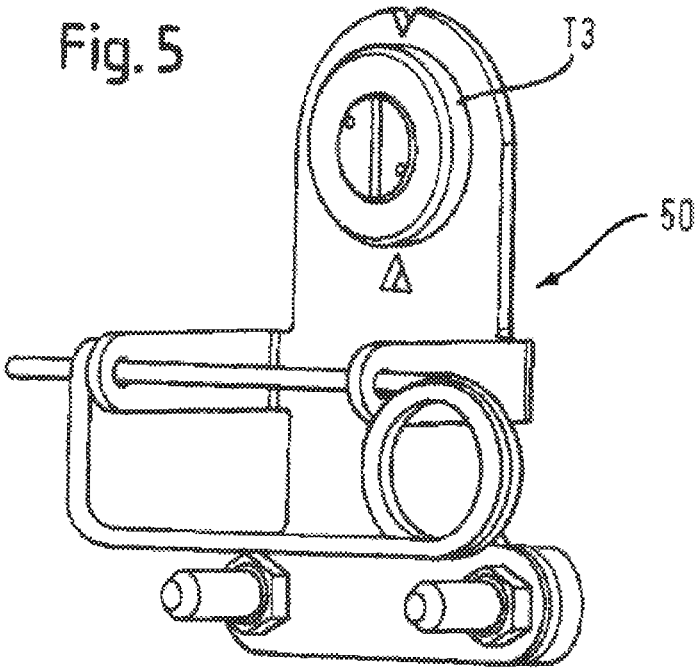
FIG. 5 shows a quick-release mount for the hoisting limit switch of the present disclosure as shown in FIG. 4.

An example mounting portion 50 of the quick-assembly embodiment is shown in detail in FIG. 5. In the illustrated variant of the mounting portion, the externally arranged transponder T3 is firmly integrated in the mounting portion. When the demountable portion of hoisting limit switch 22 is correctly inserted in the mounting portion, transponder T3 is located in a read-write area of read-write device 20 of the limit switch. From this position, the data stored on the transponder T3 are read out from the hoisting limit switch 22 and communicated to a central control unit via the bus connection 24.

A writing procedure likewise is possible on transponder T3, in order to write data to transponder T3 during the crane operation. Accordingly, the read-write device may, in one embodiment, be further configured to write data to the data-storage system. What is conceivable here are, e.g., all data concerning the load spectrum. When the transponder T3 is firmly integrated in mounting portion 50 from FIG. 5, it must be ensured that the quick-assembly device 50 is firmly mounted at the required position of the lifting device, to ensure correspondence of the data stored on the transponder T3 with respect to the component 40.

Figure 6:
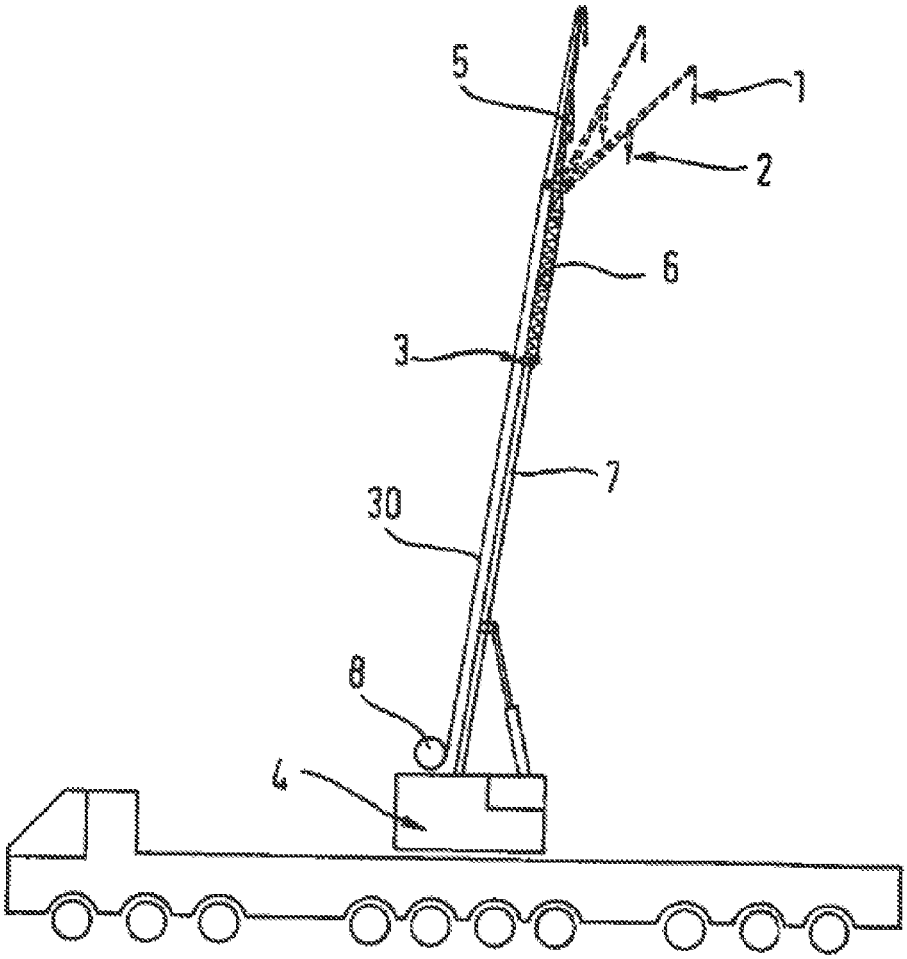
FIG. 6 shows a lifting device of the present disclosure in the form of a mobile crane.

FIG. 6 schematically shows a representation of a lifting device of the present disclosure in the form of a mobile crane, which includes an inventive arrangement of sensor devices in the form of the above-described hoisting limit switches 22 in direct vicinity of three different cable guides on the mobile crane. The lifting device comprises a hoisting cable, a winch configured to receive and draw in the hoisting cable, a plurality of cable guides configured to guide the hoisting cable, and a sensor disposed within sensing range of the plurality of cable guides. The sensor is configured to independently detect a mounting position on each of the plurality of cable guides. In one embodiment, the sensor may be demountable. In another embodiment, the sensor may further detect a position of the hoisting cable relative to at least one cable guide.

In the embodiment of FIG. 6, the mobile crane includes three different guiding means—i.e., cable guides—for guiding a hoisting cable 30. The mobile crane consists of a telescopic main boom 7 with a pulley head 3 arranged at the upper end. The boom extension 6 with a luffably mounted luffing jib 5 serves to extend the main boom 7. The luffing jib 5 includes the two guiding means 1 and 2, which can be guided via a hoisting cable 30. To accomplish the monitoring of the hoisting cable 30 on cable guides 1, 2 and 3, sensors are arranged in direct vicinity of the cable guides. At the same time, the mobile crane provides a bus system which transmits the signals of the individual arranged sensors to a central controller 4. In accordance with the present disclosure, the individual sensors independently detect their position at the boom system of the mobile crane and communicate the same to the central crane controller during operation of the crane.

To minimize the safety risks, the control unit 4 can require the individual actuation of each assigned sensor before commencement of the crane operation. Operatively coupled to each sensor, the control unit receives data from the sensors. Such data may include one or more of: an identification of which lifting-device component the sensor is arranged on; a position of the hoisting cable relative to at least one cable guide; an address assigned to the sensor based on its mounting position; and geometrical data of the lifting-device component that the sensor is arranged on. Thus, it is clearly known to the controller which winch 8 performs a hoisting operation at which point or cable guide—e.g., 1, 2, 3. If a fault is detected, the control unit 4 need only stop the particular winch responsible for the fault. Selectively actuating the hoisting limit switches 22 is possible and leads to advantageous results, but this is also a separate working step which might also be emitted when setting up the crane. When this step is required, it will efficiently be performed directly when erecting the boom 7, since then only a small distance must be covered by the respective hoisting cable 30, until the hoisting limit switch 22 is actuated. Alternatively, it would be possible that the crane is set up without this requirement. During operation of the crane, each hoisting limit switch 22 is monitored by the controller 4, as before. When a hoisting limit switch 22 is actuated, the controller 4 checks whether the crane movement can clearly be allocated to a winch 8, for example, if only one winch 8 is being operated. In this case, the controller only switches off this one winch 8 and remembers the allocation of winch 8 to cable guide 21 and hoisting limit switch 22. In this way, the crane learns its configuration during operation with a very high safety. To this end, the control unit actuates the appropriate winch in dependence on data transmitted by the sensor.

Furthermore, the mobile crane of the present disclosure offers the possibility that the sensors can also be used at points where hoisting operations must be carried out for assembly purposes of the mobile crane. As an example, reference is made to the assembly of the lattice boom with the SA trestle or the derrick boom.

Finally, it will be understood that the articles, systems, and methods described hereinabove are embodiments of the present disclosure—non-limiting examples for which numerous variations and extensions are contemplated as well. Accordingly, the present disclosure includes all novel and non-obvious combinations and sub-combinations of the articles, systems, and methods disclosed herein, as well as any and all equivalents thereof.

The invention claimed is:

1. A limit switch for limiting a hoisting of a cable, the limit switch comprising:

a data-storage system configured to store data reflecting an operating condition of the limit switch, the data-storage system comprising first and second transponders arranged inside of the limit switch; and a read-write device configured to read data from the data-storage system and write any desired data onto the data-storage system, the read-write device arranged inside of the limit switch.

2. The limit switch of claim 1, wherein the read-write device includes a read-write area and is configured to read data from the data-storage system through the read-write area.

3. The limit switch of claim 2, wherein the first and second transponders are addressable by the read-write device.

4. The limit switch of claim 3, wherein the first and second transponders are mounted beside each other on a movably guided carrier.

5. The limit switch of claim 4, wherein the movably guided carrier moves with respect to the read-write area in response to the operating condition, such that either the first or the second transponder moves into the read-write area, depending on the operating condition.

6. The limit switch of claim 5, wherein the first transponder moves into the read-write area when the operating condition is an allowed condition, and wherein the second transponder moves into the read-write area when the operating condition is a forbidden condition.

7. The limit switch of claim 3, wherein the read-write device is configured to read data from and write data to the data-storage system through a plurality of data-reading and data-writing areas, wherein the first and second transponders are among a plurality of transponders of the data-storage system addressable by the read-write device, and wherein the plurality of transponders are distributed in two or more directions.

8. The limit switch of claim 3, wherein the data-storage system further comprises a third, externally arranged transponder addressable by the read-write device, and wherein the third transponder is assigned data responsive to a mounting position of the limit switch.

9. The limit switch of claim 2 further comprising a connection to a bus system for transmitting data from the data-storage system to a controller.

10. The limit switch of claim 9, wherein the data further reflects a mounting position of the limit switch.

11. A lifting device comprising:

a cable;

a limit switch for limiting a hoisting of the cable, the limit switch comprising a data-storage system configured to store data reflecting an operating condition of the limit switch, and a read-write device arranged inside of the limit switch and having a read-write area, the read-write device configured to read data from the data-storage system through the read-write area and write any desired data onto the data-storage system through the read-write area;

a weight movably guided on the cable; and a connecting element linking the weight to the limit switch, the connecting element exerting a force on the limit switch when the operating condition is allowed.

12. The device of claim 11, wherein the force is a first force, and wherein the connecting element exerts a second force, different than the first, when the operating condition is forbidden.

13. The limit switch of claim 12 further comprising a mounting portion, wherein the data-storage system and the read-write device are coupled in a demountable portion releasable from the mounting portion via a quick release.

14. The limit switch of claim 13, wherein the mounting portion includes at least one transponder.

15. A lifting device comprising:

a hoisting cable;

one or more winches configured to receive and draw in the hoisting cable;

one or more cable guides configured to guide the hoisting cable; and one or more limit switches disposed within sensing range of the one or more cable guides and configured to independently detect a mounting position on each of the one or more cable guides;

wherein each limit switch limits a hoisting of the hoisting cable, and comprises a data-storage system configured to store data reflecting an operating condition of the limit switch and a read-write device, the read-write device arranged inside the limit switch and configured to read data from the data-storage system and write any desired data onto the data-storage system.

16. The lifting device of claim 15, wherein each limit switch is demountable.

17. The lifting device of claim 15, wherein each limit switch further detects a position of the hoisting cable relative to at least one cable guide.

18. The lifting device of claim 15 further comprising a control unit operatively coupled to each limit switch.

19. The lifting device of claim 18, wherein the control unit receives data from each limit switch, and wherein the data received from each limit switch includes one or more of:

an identification of which lifting-device component the limit switch is arranged on;

a position of the hoisting cable relative to at least one cable guide;

an address assigned to the limit switch based on its mounting position;

and geometrical data of the lifting-device component that the limit switch is arranged on.

20. The lifting device of claim 18, wherein the control unit actuates each winch in dependence on data transmitted by the one or more limit switches.

21. The lifting device of claim 20, wherein each winch is separately actuated by the control unit.

22. The lifting device of claim 18, the control unit is configured to actuate each of the one or more limit switches before commencing operation of the lifting device.

23. The lifting device of claim 18, wherein the control unit is further configured to detect whether the limit switch is defective.

24. The lifting device according to claim 15, wherein the read-write device has a read-write area and is configured to read data from the data-storage system through the read-write area.

* * * * *